United States Patent [19]

Rodel

[11] Patent Number: 5,020,255

[45] Date of Patent: Jun. 4, 1991

[54] CARD HOLDER

[76] Inventor: Robin F. Rodel, 17 Arne Crescent, Montclair, Durban, South Africa

[21] Appl. No.: 405,957

[22] Filed: Sep. 12, 1989

[30] Foreign Application Priority Data

Sep. 12, 1988 [ZA] South Africa ..... 88/6789

[51] Int. Cl.[5] ..... G09F 3/20

[52] U.S. Cl. ..... 40/654; 206/37.1; 206/39.5

[58] Field of Search ..... 40/650, 651, 642, 661, 40/649, 490, 488, 611, 653, 654; 283/80, 81; 206/37, 37.1, 37.2, 37.3, 37.4, 485, 489, 39, 39.5, 39.6

[56] References Cited

U.S. PATENT DOCUMENTS

| | | | |
|---|---|---|---|
| 658,158 | 9/1900 | Millen | 40/650 |
| 865,886 | 9/1907 | Guinn | 40/649 |
| 930,776 | 8/1909 | Milleson | 40/649 |
| 1,288,395 | 12/1918 | Duncan | 40/649 |
| 1,970,621 | 8/1934 | Peterson et al. | 40/651 |
| 2,213,075 | 3/1940 | Ross | 40/661 |
| 2,397,780 | 4/1946 | Emde | 24/3 F |
| 2,506,199 | 5/1950 | Coley | 206/37.1 |
| 2,506,509 | 5/1950 | Kratkowski | 40/156 |
| 4,209,117 | 6/1980 | Corinaldi et al. | 24/163 K |
| 4,543,692 | 10/1985 | Ode et al. | 24/163 K |
| 4,674,628 | 6/1987 | Prinsloo et al. | 206/38 |

*Primary Examiner*—Kenneth J. Dorner
*Assistant Examiner*—James M. Gardner
*Attorney, Agent, or Firm*—Bierman and Muserlian

[57] ABSTRACT

A card holder has a moulded body for holding a plurality of cards. The moulded body comprises a base wall and two spaced side walls extending from the base wall. The side walls have channels for holding cards in a spaced relationship with respect to each other. The channels have access openings at their one end for permitting insertion of cards into and removal of cards from the channels. The card holder has a resiliently displaceable retaining tab extending from the body. The retaining tab is integral with the base wall. The tab has a lug at its free end. The retaining tab is displaceable from a first position, in which the lug restricts the removal of a card held in the channels to a second position in which a card can be inserted into and removed from the channels, via the access openings. The body of the card holder also has a hole formed therein, for attaching a key ring to the card holder.

14 Claims, 2 Drawing Sheets

CARD HOLDER

SUMMARY OF THE INVENTION

This invention relates to a card holder.

In particular, this invention relates to a card holder that is attachable to or incorporates a key ring. According to this invention there is provided a card holder, which includes:

a moulded body having a base wall and two spaced side walls extending from the base wall and having holding formations for holding at least one card, the said holding formations having access openings permitting insertion of a card into and removal of a card from the holding formations;

a resiliently displaceable retaining tab extending from the body and having a lug at a free end thereof, the retaining tab being displaceable from a first position in which the lug restricts the removal of a card held in the holding formations to a second position in which a card can be inserted into or removed from the holding formations via the access openings; and attachment means for attaching a least one key to the card holder.

The side walls of the card holder may have holding formations for holding at least two cards in a spaced relationship with respect to each other.

Particularly, the holding formations may include pairs of channels, the channels of each pair being formed along each of the side walls respectively, the said pairs of channels permitting cards to be held in the card holder in a parallel spaced relationship to the base wall.

The body may include an end wall extending between the side walls at one end of the base wall, the access openings of the holding formations being located at the opposite end of the base wall. Further, the end wall may include a channel extending between the holding formations.

The end wall may also have a recess for permitting access to a card held in the holding formations for urging of a card out of the holding formations.

The retaining tab may be formed in one piece with the body and particularly, may be integral with the base wall.

In accordance with a preferred embodiment of the invention, the retaining tab is displaceable by manipulation of the lug, at least a portion of the lug being striated.

The attachment means may include a hole in the body, preferably in the end wall and typically may further include a key ring fitted in the hole.

The base wall may define at least one exposed surface on which printed matter can be applied and, as such, the body is of a material permitting printed matter to be applied thereon by screen printing.

Typically, the body is moulded from a synthetic plastics material, such as for example, polypropylene.

The invention is now described, by way of an example, with reference to the accompanying diagrammatic drawings, in which:

DESCRIPTION OF THE PREFERRED EMBODIMENT

Figure 1:
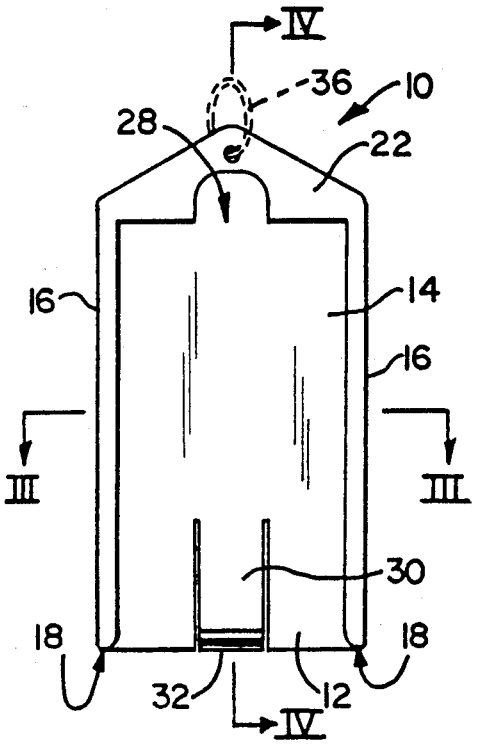
FIG. 1 a front plan view of a card holder according to this invention.

A card holder according to this invention is indicated generally by the reference numeral 10.

The card holder 10 has a moulded body 12 of a synthetic plastics material such as polypropylene.

The moulded body 12 has a base wall 14 and two spaced side walls 16 extending from the base wall 14. The side walls 16 have holding formations in the form of channels 20 for holding two cards in a spaced relationship with respect to each other. The channels 20 have access openings 18 at one end thereof for permitting insertion of a card into and removal of a card from the channels 20.

As is clearly seen in the drawings, the channels 20 form pairs, the channels of each pair being formed along each of the side walls 16 respectively.

The body 12 also has an end wall 22 extending between the side walls 16 at one end of the base wall 14. The access openings 18 of the channels 20 and the end wall 22 are located at opposite ends of the base wall 14.

The end wall 22 has channels 26 extending between the channels 20 along the side walls 16.

The end wall 22 also has a recess 28 for permitting access to a card (not shown) held in the channels 20, for urging of the card out of the channels 20.

The card holder 10 has a resiliently displaceable retaining tab 30 extending from the body 12. The tab 30 has a lug 32 at a free end thereof.

Figure 5:
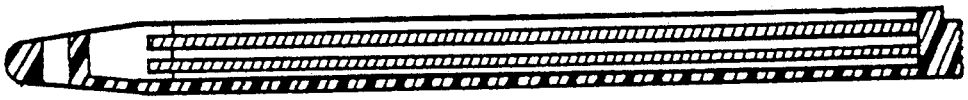
FIG. 5 is a cross sectional view of the card holder showing the retaining tab in the first position with cards in the holder.
Figure 6:
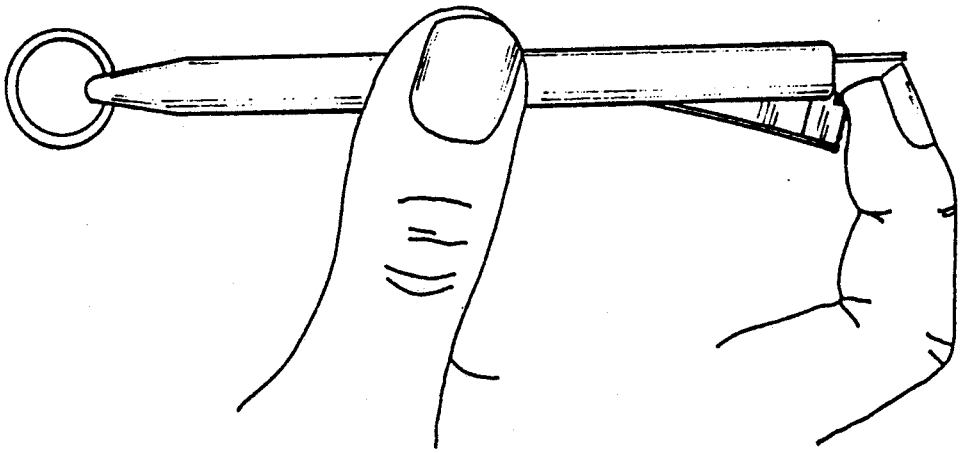
FIG. 6 is a side view of the card holder showing the retaining tab in the second position.

The retaining tab 30 is displaceable from a first position, as shown in FIG. 5, in which the lug 32 restricts the removal of a card held in the channels 20 to a second position, as shown in FIG. 6, in which a card can be inserted into the channels 20, via the access openings 18.

The retaining tab 30 is formed in one piece with the body 12 and is integral with the base wall 14.

As can be clearly understood, the retaining tab 30 is displaceable by manipulation of the lug 32. For ease of manipulation, at least a portion 33 of the lug can be striated.

The card holder 10 also includes attachment means, in the form of a hole 34 in the end wall, for attaching a key ring 36 to the card holder 10.

Figure 2:
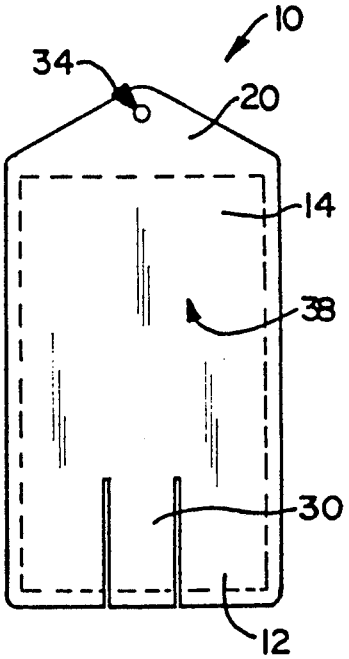
FIG. 2 a rear plan view of the card holder of FIG. 1.
Figure 3:
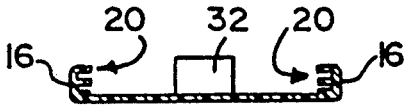
FIG. 3 a cross-sectional view of the card holder along II—III of FIG. 1.
Figure 4:
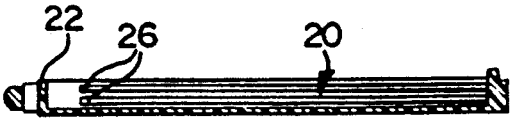
FIG. 4 a cross-sectional view of the card holder along line IV–IV of FIG. 1.

As seen in FIG. 2, the base wall 14 defines an exposed surface 38 on which printed matter can be applied by screen printing, or any other application process.

In use, the card holder 10 can hold a variety of cards such as entry cards, credit cards or bank machine operating cards, security cards, and other like cards.

The card holder in accordance with the invention can be adapted to hold even more than two cards.

I claim:

1. A one piece card holder comprising a moulded body having a base wall and two spaced side walls extending from the base wall, holding formations for holding at least one card, said holding formations having access openings permitting the insertion and removal of a said card from the holding formations and a retaining tab integral with the base wall and formed by partially slitting the base wall, having a lug at a free end thereof, resiliently displaceable between a first position, in which the lug restricts the removal of said card from the holding formations, and a second position in which the retaining tab is manually displaced for resilient return to the first position, and wherein said card can be inserted into or removed from the holding formations via the access openings; and attachment means for attaching at least one key to the card holder.

2. A card holder as claimed in claim 1, wherein the holding formations hold two cards in a spaced relationship with respect to each other.

3. A card holder as claimed in claim 1, in which the holding formations include pairs of channels, the channels of each pair being formed along each of the side walls respectively.

4. A card holder as claimed in claim 3, in which the pairs of channels permit cards to be held in the card holder in a parallel spaced relationship to the base wall.

5. A card holder as claimed in claim 3, in which the body includes an end wall extending between the side walls at one end of the base wall, the access openings of the holding formations being located at the opposite end of the base wall.

6. A card holder as claimed in claim 5, in which the end wall includes a channel extending between the holding formations.

7. A card holder as claimed in claim 1, in which at least a portion of the lug is striated.

8. A card holder as claimed in claim 1, in which the attachment means is a hole in the body.

9. A card holder as claimed in claim 1, in which the attachment means includes a key ring.

10. A card holder as claimed in claim 1, in which the base wall defines at least one exposed surface on which printed matter can be applied.

11. A card holder as claimed in claim 10 in which the body is of a material permitting the printed matter to be applied thereon by screen printing.

12. A card holder as claimed in claim 1, in which the body is moulded from a synthetic plastics material.

13. A card holder as claimed in claim 1, in which the body is made from polypropylene.

14. A card holder comprising a one-piece moulded body having a base wall and two spaced side walls extending from the base wall, holding formations for holding at least one card, said holding formations having access openings permitting the insertion removal of said card from the holding formations, the end wall has a recess to permit access to a card held in the holding formations for urging a card out of the holding formations and a retaining tab integral with the base wall and formed by partially slitting the base wall, having a lug at a free end thereof, displaceable between a first position, in which the lug restricts the removal of said card from the holding formations, and a second position in which the retaining tab is manually displaced for resilient return to the first position, and wherein said card can be inserted into or removed from the holding formations via the access openings; and attachment means for attaching at least one key to the card holder.

* * * * *